US010932532B2

(12) United States Patent
Vuilleme et al.

(10) Patent No.: US 10,932,532 B2
(45) Date of Patent: Mar. 2, 2021

(54) BRACELET CLASP

(71) Applicant: Omega SA, Biel/Bienne (CH)

(72) Inventors: Eric Vuilleme, Provence (CH); Yohann Ferraroli, Maiche (FR)

(73) Assignee: Omega SA, Biel/Bienne (CH)

( * ) Notice: Subject to any disclaimer, the term of this patent is extended or adjusted under 35 U.S.C. 154(b) by 64 days.

(21) Appl. No.: 15/968,841

(22) Filed: May 2, 2018

(65) Prior Publication Data

US 2018/0352914 A1 Dec. 13, 2018

(30) Foreign Application Priority Data

Jun. 7, 2017 (EP) ..... 17174800

(51) Int. Cl.
*A44C 5/24* (2006.01)

(52) U.S. Cl.
CPC ..... *A44C 5/24* (2013.01); *A44C 5/246* (2013.01)

(58) Field of Classification Search
CPC ..... A44C 5/24; A44C 5/246
See application file for complete search history.

(56) References Cited

U.S. PATENT DOCUMENTS 2,110,936 A * 3/1938 Myrberg ..... A44C 5/246 24/71 J
3,478,537 A * 11/1969 Berr ..... A44C 5/185 63/4
3,913,182 A * 10/1975 Fontana ..... A44C 5/2052 24/71 J
4,645,508 A * 2/1987 Shorter ..... A61F 2/6607 623/48

(Continued)

FOREIGN PATENT DOCUMENTS

CH 667 979 A5 11/1988
CN 103732095 A 4/2014

(Continued)

OTHER PUBLICATIONS

European Search Report dated Nov. 28, 2017 in European Application 17174800.7 filed on Jun. 7, 2017 (with English Translation of Categories of Cited Documents and Written Opinion).

(Continued)

*Primary Examiner* — Jason W San
(74) *Attorney, Agent, or Firm* — Oblon, McClelland, Maier & Neustadt, L.L.P.

(57) ABSTRACT

A clasp for a bracelet or wristband includes first and second blades, the first blade being articulated to the second blade by a first end, between a closed position, in which the second blade is folded onto the first blade, and an open position, in which the second blade is released from the first blade, the first blade being articulated at a second end to a member for attaching a first wristband portion. The clasp includes an adjustment mechanism arranged to adjust the position of the second blade with respect to the first blade in an open position, the adjustment mechanism including a groove machined in the second blade, an arbor integral with the first blade and passing through the groove, the arbor receiving a pusher for releasing and/or locking it in order to move the second blade.

15 Claims, 5 Drawing Sheets

(56) References Cited

U.S. PATENT DOCUMENTS

| | | | | |
|---|---|---|---|---|
| 5,485,659 | A * | 1/1996 | Kashikie | A44C 5/2052 24/265 WS |
| 5,787,554 | A * | 8/1998 | Hashimoto | A44C 5/185 24/265 WS |
| 5,946,776 | A * | 9/1999 | Bourquin | A44C 5/24 24/265 WS |
| 6,434,798 | B1 * | 8/2002 | Yamakawa | A44C 5/24 24/265 WS |
| 7,571,519 | B2 * | 8/2009 | Sierro | A44C 5/185 24/265 WS |
| 8,001,658 | B2 * | 8/2011 | Christian | A44C 5/246 24/265 WS |
| 8,561,263 | B2 * | 10/2013 | Catanese | A44C 5/24 24/265 WS |
| 8,789,245 | B2 * | 7/2014 | Leger | A44C 5/246 24/265 WS |
| 8,918,965 | B2 * | 12/2014 | Kaltenrieder | A44C 5/24 24/68 J |
| 8,935,834 | B2 * | 1/2015 | Mouche | A44C 5/24 224/164 |
| 9,591,899 | B2 * | 3/2017 | Catanese | A44B 11/226 |
| 9,615,634 | B2 * | 4/2017 | Kaltenrieder | A44C 5/246 |
| 9,681,711 | B2 * | 6/2017 | Monard | A44C 5/04 |
| 10,278,460 | B2 | 5/2019 | Catanese | |
| 2004/0163217 | A1 * | 8/2004 | Ferrario | A44C 5/24 24/71 J |
| 2007/0283537 | A1 * | 12/2007 | Dubois | A44C 5/24 24/71 J |
| 2008/0083101 | A1 * | 4/2008 | Christian | A44C 5/246 24/71 J |
| 2013/0286797 | A1 | 10/2013 | Leger | |
| 2014/0059818 | A1 * | 3/2014 | Catanese | A44C 5/24 24/71 J |
| 2014/0130545 | A1 | 5/2014 | Leger | |
| 2014/0223705 | A1 * | 8/2014 | Catanese | A44C 5/24 24/71 J |
| 2014/0352119 | A1 * | 12/2014 | Kaltenrieder | A44C 5/246 24/71 J |
| 2015/0366303 | A1 * | 12/2015 | Pier | A44C 5/246 24/71 J |
| 2016/0309859 | A1 | 10/2016 | Catanese | |
| 2016/0345691 | A1 | 12/2016 | Monard | |
| 2017/0215531 | A1 * | 8/2017 | Wong | A44C 5/22 |

FOREIGN PATENT DOCUMENTS

| | | | |
|---|---|---|---|
| EP | 1 464 245 | A1 | 10/2004 |
| EP | 3 085 265 | A1 | 10/2016 |
| JP | 2007-330289 | A | 12/2007 |
| WO | WO 2006/092723 | A1 | 9/2006 |

OTHER PUBLICATIONS

First Office Action dated Nov. 14, 2019 in corresponding Chinese Patent Application No. 201810573972.8 (with English translation)(10 pages).

Second Office Action dated Jun. 12, 2020 in corresponding Chinese Patent Application No. 201810573972.8 (with English translation)(11 pages).

* cited by examiner

BRACELET CLASP

This application claims priority from European Patent Application No. 17174800.7 filed on Jun. 7, 2017, the entire disclosure of which is hereby incorporated herein by reference.

FIELD OF THE INVENTION

The invention relates to a clasp for a bracelet or wristband, and in particular for watch wristbands.

BACKGROUND OF THE INVENTION

There is known from EP Patent No 1464245 a clasp with a deployant buckle comprising two arched arms—one lower and one upper—each provided with a concave face and a convex face, the concave face of the upper arm being adjacent to the convex face of the lower arm in the closed position of the clasp, the upper arm being elastically bendable, locking means comprising two parts, each associated with one of the arms, the first part comprising at least two cutout portions and the second part a head arranged to snap fit inside one or other cutout portion, by elastic deformation of the upper arm, connecting means which connect the arms to each other in an articulated manner at one of their ends, about an arbor substantially parallel to the faces of the arms, and allow the upper arm to occupy at least two positions in which the head can be engaged in one or other of the cutout portions, and means for attaching wristband portions disposed at the other end of the arms.

Such a mechanism is not easy for a user to operate since the arbor is movable with the arm, which means that the arbor may, depending on clearance, be in a cantilever or an unstable position and lock in the arm in an undesired position. Further, position locking is not completely reliable—there is a risk that, when opened in the short position, the clasp will move into the long position against the user's will.

SUMMARY OF THE INVENTION

It is an object of the invention to overcome the various drawbacks of these known techniques.

More specifically, it is an object of the invention to provide a clasp that allows a simple, fast and reliable comfort extension adjustment of a watch band clasp.

Another object of the invention is to provide a clasp that can be easily dismantled for cleaning and replacing parts if necessary.

It is also an object of the invention, at least in a particular embodiment, to provide a clasp that is simple to implement and inexpensive.

These objects, in addition to others which will appear more clearly hereinafter, are achieved by the invention by means of a wristband clasp comprising at least first and second blades, the first blade being articulated to the second blade by a first end, between a closed position, called the wearing position, in which the second blade is folded onto the first blade, and an open position, in which the second blade is released from the first blade, the first blade being articulated at a second end to a member for attaching a first wristband portion, a second wristband portion being at least indirectly connected to the second blade, the clasp comprising first means for locking the first blade in a closed position on the second blade.

According to the invention, the clasp comprises adjustment means arranged to adjust the position of the second blade with respect to the first blade in an open position, the adjustment means including a groove machined in the second blade, an arbor integral with the first blade and passing through the groove, the groove having at least two recesses to define a short position and a long position, the arbor receiving a pusher for releasing and/or locking it in order to move the second blade from one recess to another.

In accordance with other advantageous variants of the invention:

- the arbor is of cylindrical shape with a diameter D1, said arbor having a reduced portion with a diameter D2 that is smaller than diameter D1 over one part of its length;
- the groove has a height H similar to diameter D2 of the reduced portion and the recesses have a diameter D3 similar to diameter D1 of the arbor, with height H being less than diameter D3 of the recesses;
- the pusher includes a spring to hold it in its rest position inside one of the recesses, the reduced portion of diameter D2 being offset longitudinally with respect to the groove in the rest position;
- the pusher is housed inside the first blade, in proximity to the articulation at its first end;
- the arbor and the pusher form a one-piece element.
- The groove includes at least a third recess, called the intermediate recess, disposed between the first and second recesses to define an intermediate position between the long position and the short position;
- the first means for locking the first blade in a closed position on the second blade include, on the one hand, at least one ball ratchet integral with the second blade, and on the other hand, an orifice formed in the first blade and arranged to cooperate with the ball ratchet;
- the clasp includes a third blade articulated to the second end of the first blade, a base plate pivotably articulated to the third blade, and a cover pivotably articulated to the base plate, the first wristband portion being held by means of holding means, the cover including second means for locking the cover in a closed position on the first blade;
- the second means for locking the cover in a closed position include a hole through the base plate, arranged to cooperate with a post integral with the first blade, the cover including at least one pusher arranged to be moved in a direction perpendicular to the clasp, in response to an action of the user, between a first position of rest, in which the cover is locked in a closed position on the first blade, and a second, pushed-in position, in which the cover is released from the first blade;
- the cover partially covers the second blade in the closed position.

The invention also concerns a wristwatch including a bracelet or wristband provided with a clasp according to the invention.

Thus, by means of the various functional and structural aspects described above, the present invention makes it possible to obtain a clasp wherein it is particularly easy and quick to adjust the length of a wristband portion.

BRIEF DESCRIPTION OF THE DRAWINGS

Other characteristics and advantages of the invention will appear more clearly upon reading the following description of a specific embodiment of the invention, given simply by way of illustrative and non-limiting example, and the annexed Figures, among which:

FIGS. 3*a* and 3*b* respectively illustrate a top view and a cross-sectional view along line G-G of a clasp according to the invention in the short position.

FIGS. 4*a* and 4*b* respectively illustrate a top view and a cross-sectional view along line M-M of a clasp according to the invention in the long position.

FIGS. 5*a*, 5*b* and 5*c* respectively illustrate a cross-sectional view of a clasp according to the invention, a cross-sectional view of the adjustment means in the unlocked position, and a cross-sectional view of the adjustment means in the locked position.

DETAILED DESCRIPTION OF PREFERRED EMBODIMENTS

Figure 1:
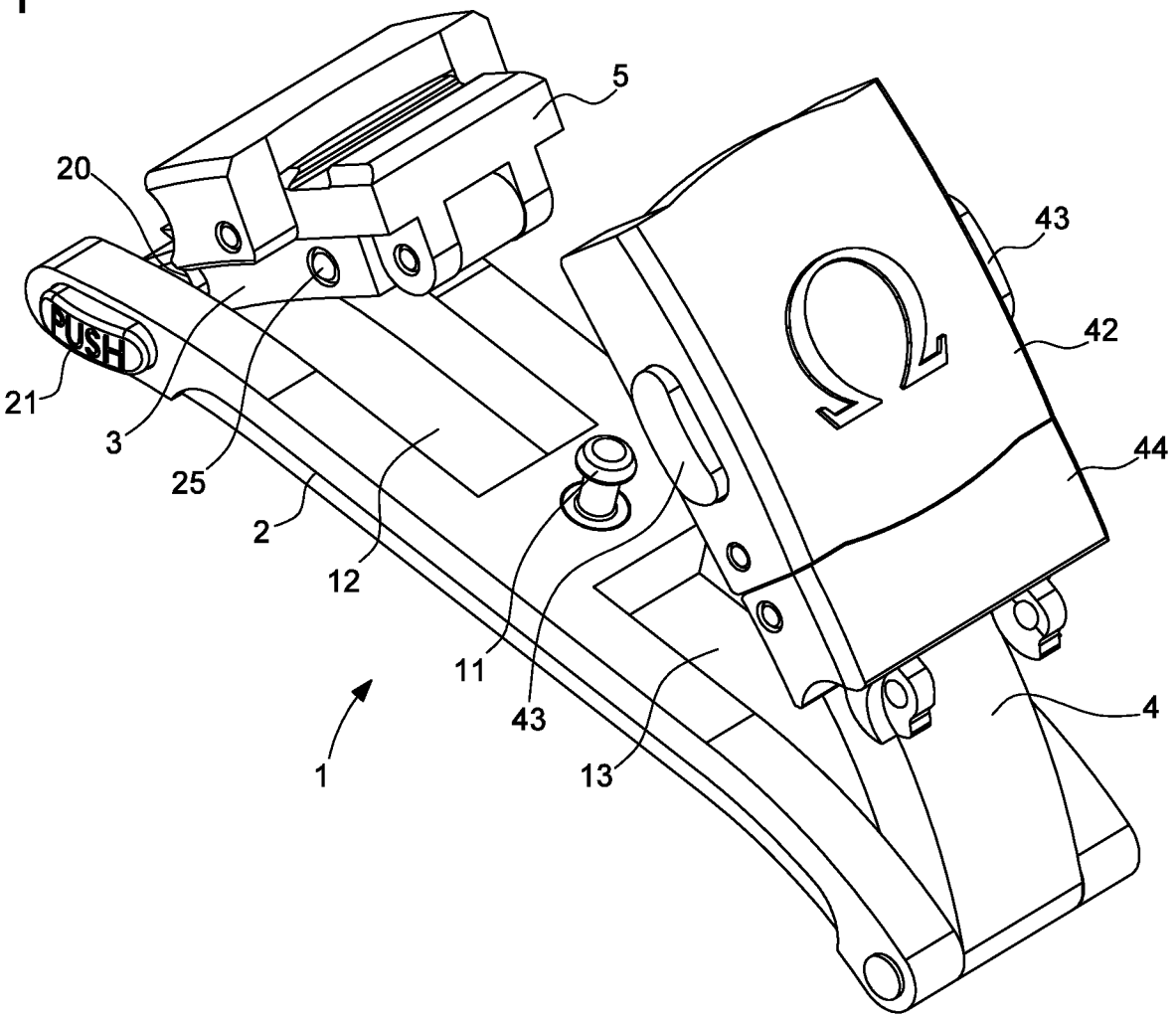
FIG. 1 is a perspective view of a clasp according to the invention.

A clasp for an adjustable wristband according to a first example embodiment will now be described below with reference jointly to FIGS. 1, 2*a*, 2*b*, 2*c*, 2*d*, 3*a*, 3*b*, 4*a*, 4*b*, and 5*a*, 5*b* et 5*c*.

The invention concerns a clasp 1 for a bracelet or wristband, of the deployant buckle type, comprising at least first and second blades, the first blade 2 being articulated to the second blade 3 by a first end, between a closed position, called the wearing position, in which second blade 3 is folded into first blade 2, and an open position in which second blade 3 is released from first blade 2.

At a second end, first blade 2 carries means for attaching a first wristband portion, a second wristband portion being at least indirectly connected to first blade 2 by means of an attaching link 5, for example, second blade 3 including first locking means capable of holding second blade 3 in its closed position. The means for attaching the first wristband portion or the first link may take the form of a third blade 4, as illustrated in the Figures, or the portion or link could simply be directly attached to first blade 2, or indirectly attached to first blade 2 via an intermediate articulated element.

The wristband portions may be made from materials such as leather, fabric, canvas, or any other material known to those skilled in the art for producing wristbands or belts.

Bracelet links could also be attached thereto, whether they are made of metal, ceramic, composite material or any other material known to those skilled in the art of manufacturing links.

First blade 2 may, for example, have a through orifice at its centre, called central orifice 10, the central orifice being configured to receive a post 11 so that the post cooperates with pushers or any other clasp locking means known to those skilled in the art within the scope of the present invention. Fixed hooks, configured to cooperate with other hooks disposed on pushers for example, could also be placed on first blade 2.

The clasp includes means for adjusting the position of second blade 3 with respect to first blade 2 in the open position. The adjustment means include, on the one hand a groove 30 machined in second blade 3, visible in FIG. 2*d*, and on the other hand, an arbor 20 integral with first blade 2 and arranged to pass through groove 30.

Figure 2A:
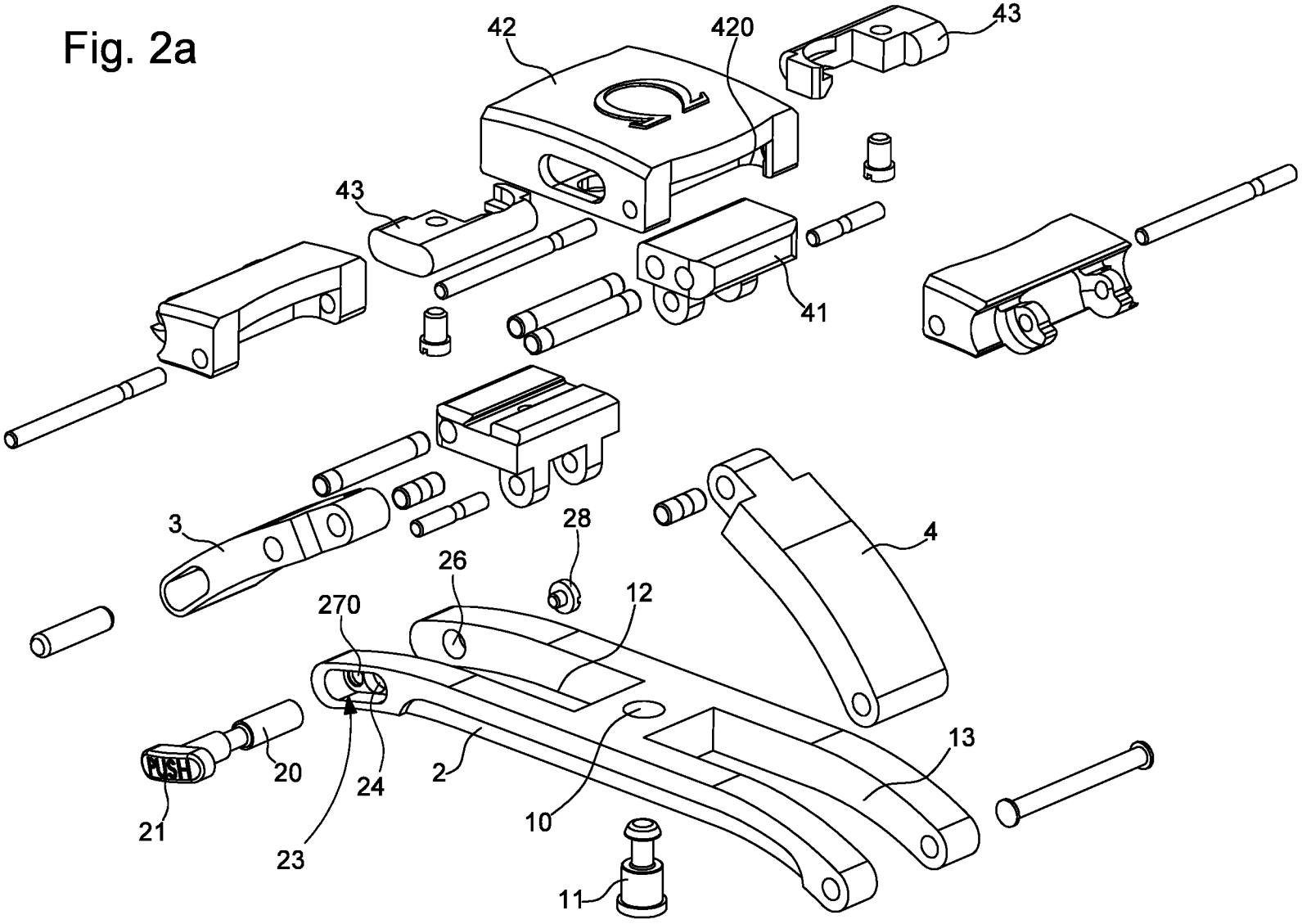
FIG. 2*a* is an exploded view of a clasp according to the invention.
Figure 2B:
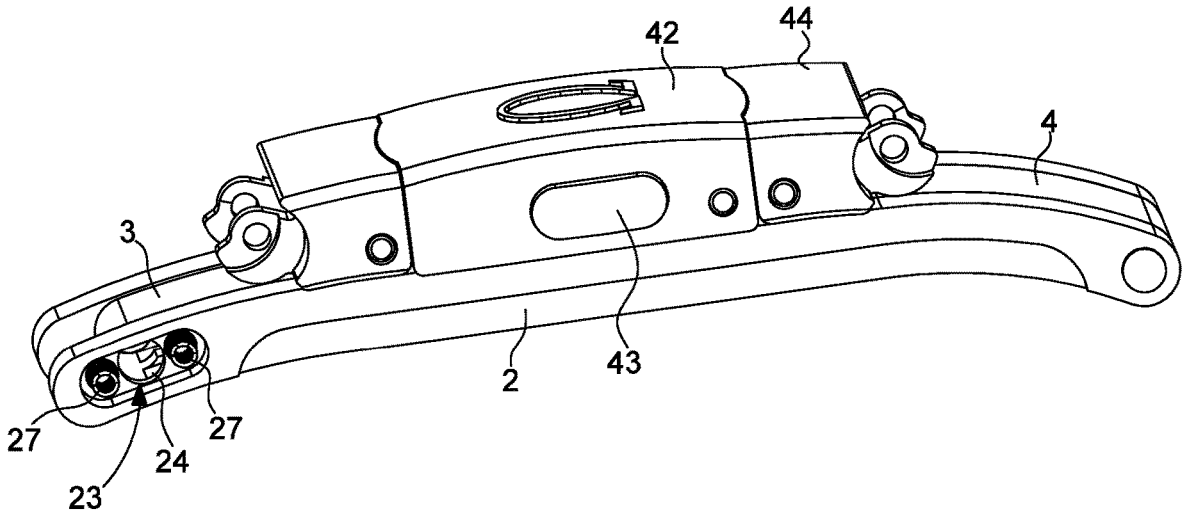
FIG. 2*b* is a perspective view of the clasp according to the invention.
Figure 2C:
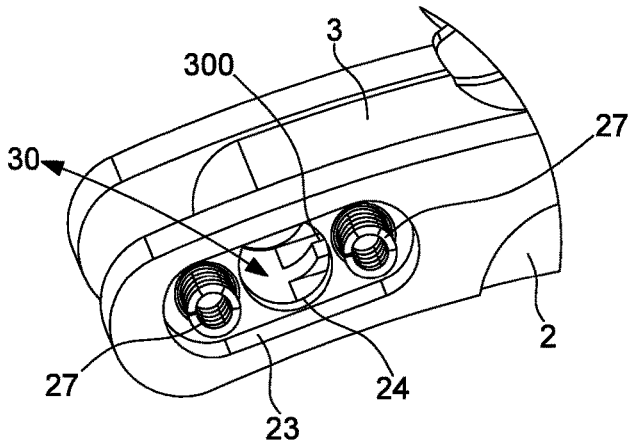
FIG. 2*c* is a detailed view of the second blade of a clasp according to the invention.
Figure 2D:
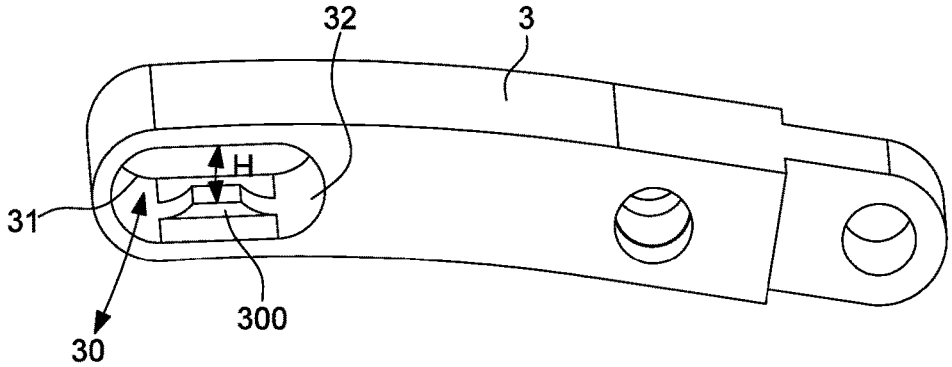
FIG. 2*d* is a detailed view of the adjustment means, particularly of the groove, of a clasp according to the invention.
Figure 3A:
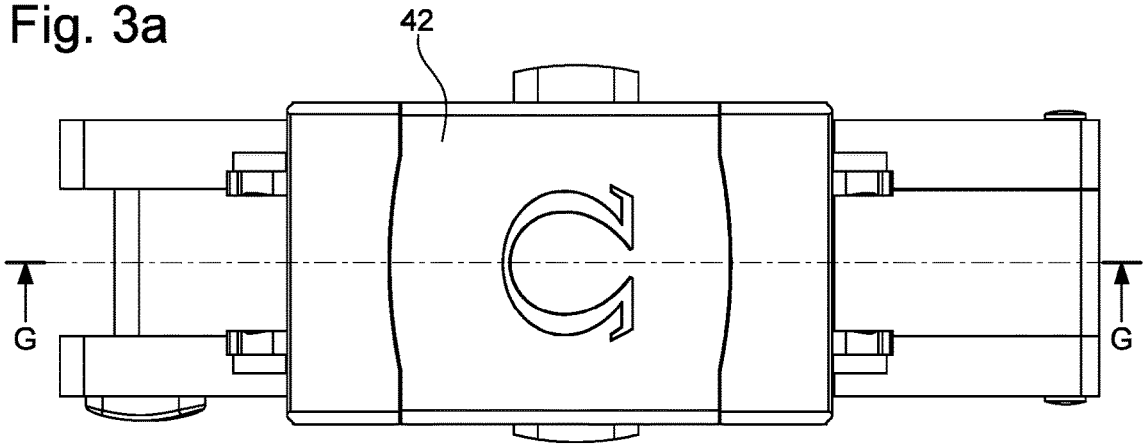
Figure 3A:
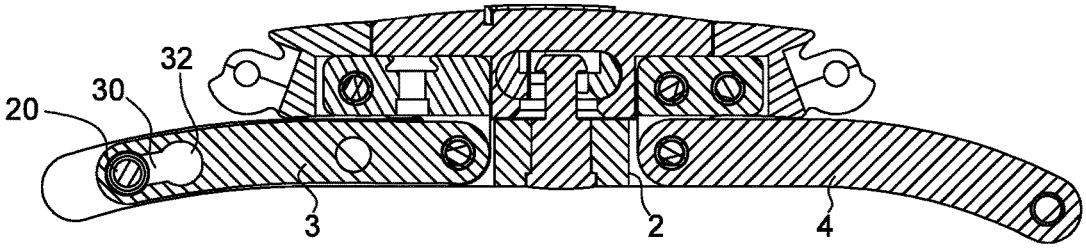
Figure 4A:
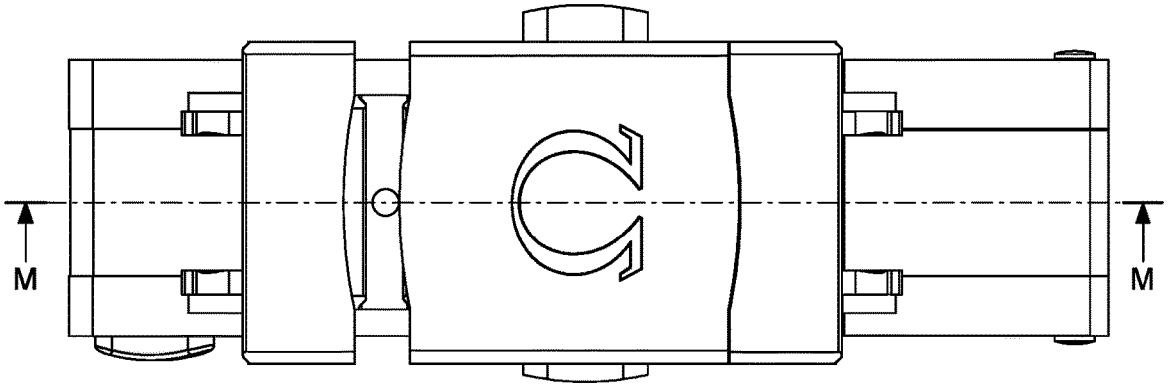
Figure 4A:
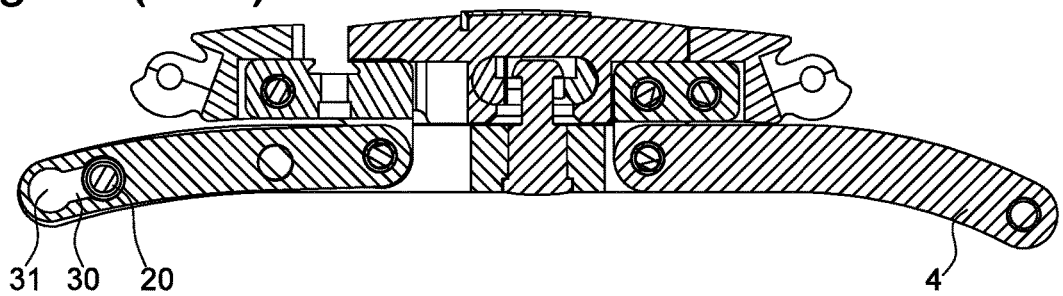
Figure 5A:
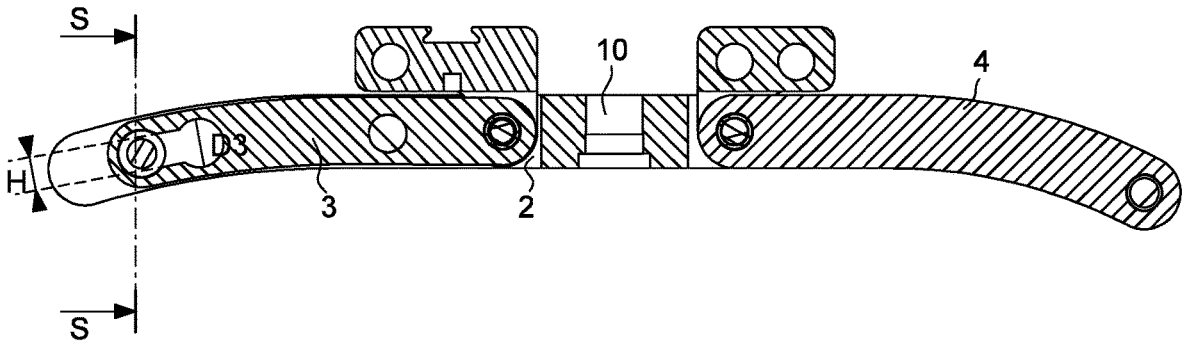
Figure 5A:
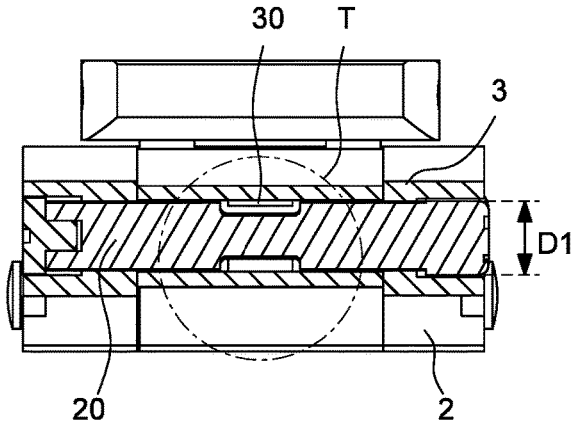
Figure 5A:
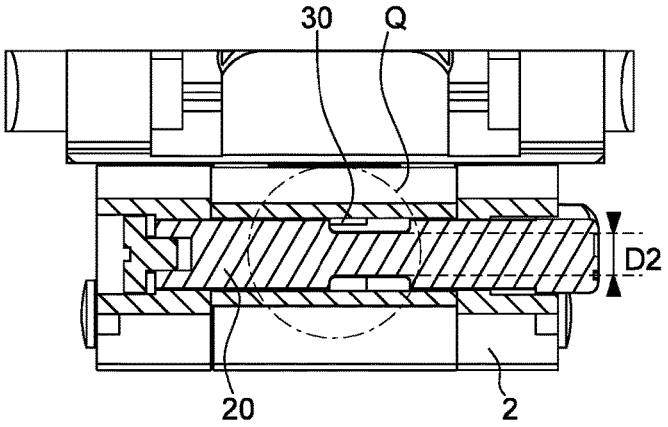

As can be observed in FIG. 2*d*, groove 30 has at least two recesses 31, 32 to define a short position and a long position, and a portion of reduced height H with respect to the two recesses 31 and 32, the reduced portion could be achieved by means of two ramps 300 placed symmetrically at the centre and on the upper and lower parts of groove 30.

Arbor 20 receives a pusher 21 at one of its ends for releasing and/or locking it in order to move second blade 3 from one recess 31, 32 to another, the other end of the arbor being secured to the first blade via a screw 28, for example.

In order to limit the space required for the adjustment means, pusher 21 is partly housed inside first blade 2, in proximity to the articulation at its first end. To this end, first blade 2 has a housing 23 of complementary shape to the shape of pusher 21, housing 23 including the first through hole 24 to allow arbor 20 to pass through first blade 2.

As illustrated in the Figures, pusher 21 takes the form of a body with an oblong section and rests partly inside housing 23, so that pusher 21 projects slightly and thereby facilitates actuation. Other forms can obviously be envisaged for the pusher, such as a circular or rectangular section. Those skilled in the art could also envisage inserting a pusher 21 flush with first blade 2 for the sake of design, but this would make it more difficult to activate the pusher.

According to a particular embodiment of the invention, arbor 20 and pusher 21 form a one-piece element. They may, of course, also be two distinct elements; pusher 21 could, for example, be screwed in or driven onto arbor 20.

As illustrated in FIGS. 2, 5*b* and 5*c*, arbor 20 is of cylindrical shape and includes three portions, first and third portions of diameter D1, and a second portion positioned between the first and third portions, called the reduced portion, having a smaller diameter D2 than diameter D1. Arbor 20 traverses in succession first blade 2, through a first through hole 24, then the second blade through groove 30, and then first blade again, through a second through hole 26. Arbor 20 is held in place by the pusher at its first end and by screw 28 at its other end, with screw 28 resting inside hole 26.

Arbor 20 is arranged to traverse groove 30, which has a height H similar to diameter D2 of the reduced portion of arbor 20. Recesses 31 and 32 have a diameter D3 similar to arbor diameter D1, height H being less than diameter D3 of the recesses to avoid inadvertent misadjustment of the clasp.

Advantageously, pusher 21 includes at least one spring 27 to hold it in its rest position inside one of recesses 31 or 32, the reduced portion of diameter D2 being offset longitudinally with respect to groove 30 in its rest position. To obtain a simple structure, spring 27 can be placed inside housing 23, between pusher 21 and first blade 2.

As illustrated in FIGS. 2*b* and 2*c*, housing 23 includes two springs 27, each of springs 27 resting partly inside a machined portion 270 to hold them in place. Springs 27 are disposed on each side of through hole 24, through which arbor 20 passes in order to better distribute forces and obtain the most rectilinear movement possible when the wearer pushes pusher 21.

Depending on the needs of the wearer, groove 30 may include at least a third recess, called the intermediate recess, disposed between first and second recesses 31 and 32, to define an intermediate position between the long position and the short position. Those skilled in the art could add the number of recesses necessary, however, it is not desirable to have too many possible adjustments for simplicity of implementation and ease of operation of clasp 1 by the user.

Advantageously, first blade 2 is arranged to be slightly longer so that there is no space between first blade 2 and second blade 3, at the end of the two blades 2 and 3 in proximity to the articulation, when the latter is positioned in the long position.

The first locking means may be formed, for example, by at least one ball ratchet 25 configured to cooperate with an orifice formed in first blade 2, so as to hold first blade 2 in its closed position against second blade 3 and thus prevent any misadjustment of second blade 3 once the latter has been folded onto first blade 2.

Thus, to adjust the clasp, the user first unfolds second blade 3 from first blade 2. Then, the user presses pusher 21 to shift arbor 20 from its rest position, as in FIG. 5*c*, towards its retracted position, as in FIG. 5*b*, thus the reduced portion of arbor 20 is placed opposite groove 30 and the wearer can then move second blade 3 from recess 31 to recess 32 or vice versa. Finally, once second blade 3 is positioned in the desired recess, the wearer releases pusher 21 which returns to its rest position under the effect of the spring, the first portion then being opposite groove 30 and preventing any translational motion of second blade 3. The wearer then simply has to close clasp 1 to wear the watch.

According to the embodiment illustrated in the Figures, the clasp includes a third blade 4 articulated to the second end of first blade 2, a base plate 41 is pivotably articulated to the third blade 4, and a cover 42 is mounted on base plate 41, the first wristband portion or link being held by means of holding means 44.

Second blade 3 and third blade 4 can move from a closed position, called the wearing position, in which second blade 3 and third blade 4 are folded onto first blade 2, to an open position, in which second blade 3 and third blade 4 are released from first blade 2.

As can be observed in FIGS. 1 and 2, first blade 2 includes two longitudinal cutaway portions 12 and 13 disposed symmetrically on either side of central orifice 10. Advantageously, longitudinal cutaway portions 12 and 13 are of complementary shape respectively to second blade 3 and third blade 4.

Thus, second blade 3 and third blade 4 rest at least partially inside longitudinal housings 12 and 13, so that the second end of second blade 3 and of third blade 4 rest in immediate proximity to central orifice 10.

As illustrated in FIG. 2, base plate 41 is inserted at one end of cover 42, since cover 42 has a recessed portion 420 for receiving base plate 41.

Cover 42 includes second means for locking the cover in a closed position on first blade 2, the second locking means including a hole through the base of cover 42, arranged to cooperate with post 11 integral with first blade 2, and two pushers 43 arranged to be moved in a direction perpendicular to clasp 1, in response to pressure by the user, between a first, rest position in which cover 42 is locked in a closed position on first blade 2, and a second, pushed-in position in which cover 42 is released from first blade 2.

Pushers 43 are formed by a body, of greater length than the width of cover 42, so as to project from either side of the cover. Pushers 43 are slidably mounted inside guide slots formed in the lateral edges of cover 42 and abuttingly engage with a spring to hold them apart. As can be observed in the Figures, each pusher has a passage and a hook to allow post 11 to pass and to hold it when pushers 43 are biased by the spring.

The invention also concerns a wristwatch including a bracelet or wristband provided with a clasp as previously described.

As a result of these different aspects of the invention, there is provided a clasp of simple design allowing adjustment of the length of a portion of a wristband or belt.

Of course, the present invention is not limited to the illustrated example and is capable of various variants and modifications that will appear to those skilled in the art.

What is claimed is:

1. A clasp for a wristband or bracelet comprising:

at least first and second blades, the second blade being pivotally attached to the first blade by an arbor passing through a groove in a first end of the second blade, between a closed position, called the wearing position, in which the second blade is folded onto the first blade, and an open position, in which the second blade is released from the first blade, the first blade being articulated at a second end to a member for attaching a first wristband portion, a second wristband portion being at least indirectly connected to the second blade and the clasp including first means for locking the first blade in a closed position on the second blade, wherein the clasp includes means for adjusting the position of the second blade with respect to the first blade in an open position, the adjustment means including the groove machined in the second blade, the arbor integral with the first blade and passing through the groove, the groove having at least two recesses to define a short position and a long position, and a pusher attached to an end of the arbor to release or lock the arbor in order to move the second blade from one recess to another.

2. The wristband clasp according to claim 1, wherein the arbor is of cylindrical shape with a diameter D1, said arbor having a reduced portion with a diameter D2 that is smaller than the diameter D1 over part of its length.

3. The clasp according to claim 2, wherein the groove has a height H similar to the diameter D2 of the reduced portion and the recesses have a diameter D3 similar to the diameter D1 of the arbor, height H being less than the diameter D3 of the recesses.

4. The clasp according to claim 3, further comprising at least one spring to hold the pusher in a rest position inside one of the recesses, the reduced portion of the diameter D2 being offset longitudinally with respect to the groove in the rest position.

5. The clasp according to claim 1, wherein the pusher is at least partially housed inside the first blade, in proximity to the articulation at the first end thereof.

6. The clasp according to claim 1, wherein the arbor and the pusher form a one-piece element.

7. The clasp according to claim 1, wherein the groove includes at least a third recess, called the intermediate recess, disposed between the first and second recesses so as to define an intermediate position between the long position and the short position.

8. The clasp according to claim 1, wherein the first means for locking the first blade in a closed position on the second blade include, on the one hand, at least one ball ratchet integral with the second blade, and on the other hand, an orifice formed on the first blade and arranged to cooperate with the ball ratchet.

9. The clasp according to claim 1, comprising a third blade articulated to the second end of the first blade, a base plate pivotably articulated to the third blade, and a cover being pivotably articulated to the base plate, the first wristband portion being held by means of holding means, the cover comprising second means for locking the cover in a closed position on the first blade.

10. The clasp according to claim 9, wherein the second means for locking the cover in a closed position comprise a hole through the base plate of the cover arranged to cooperate with a post integral with the first blade, the cover comprising at least one pusher arranged to be moved in a direction perpendicular to the clasp, in response to an action of the user, between a first, rest position in which the cover is locked in a closed position on the first blade, and a second, pushed-in position in which the cover is released from the first blade.

11. The clasp according to claim 9, wherein the cover at least partly covers the second blade in the closed position.

12. A wristwatch comprising:

a wristband or bracelet provided with the clasp according to claim 1.

13. The clasp according to claim 1, further comprising at least one spring positioned between the pusher and the first blade and, the spring being in direct contact with the pusher to hold the pusher in a rest position.

14. A clasp for a wristband or bracelet comprising:

a first blade;

a second blade, the second blade being pivotally attached to the first blade by an arbor passing through the first blade and a groove in a first end of the second blade, between a closed position, called the wearing position, in which the second blade is folded onto the first blade, and an open position, in which the second blade is released from the first blade, the first blade being articulated at a second end to a member for attaching a first wristband portion, a second wristband portion being at least indirectly connected to the second blade, wherein the groove includes a first recess and a second recess, the arbor is positioned in the first recess to define a short position of the second blade with respect to the first blade, and the arbor is positioned in the second recess to define a long position of the second blade with respect to the first blade, and wherein a pusher is attached to an end of the arbor to release or lock the arbor in order to move the second blade between the first recess and the second recess.

15. The clasp according to claim 14, further comprising at least one spring positioned between the pusher and the first blade and, the spring being in direct contact with the pusher to hold the pusher in a rest position.

* * * * *